US012053852B2

(12) United States Patent
Tanahashi et al.

(10) Patent No.: US 12,053,852 B2
(45) Date of Patent: Aug. 6, 2024

(54) BARREL POLISHING APPARATUS

(71) Applicant: SINTOKOGIO, LTD., Nagoya (JP)

(72) Inventors: Shigeru Tanahashi, Nagoya (JP); Hiroaki Suesuga, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 351 days.

(21) Appl. No.: 17/177,661

(22) Filed: Feb. 17, 2021

(65) Prior Publication Data

US 2021/0268622 A1 Sep. 2, 2021

(30) Foreign Application Priority Data

Feb. 28, 2020 (JP) ..... 2020-033850
Oct. 16, 2020 (JP) ..... 2020-174906

(51) Int. Cl.
*B24B 31/108* (2006.01)
*B24B 31/02* (2006.01)
*B24B 31/023* (2006.01)

(52) U.S. Cl.
CPC ..... *B24B 31/108* (2013.01); *B24B 31/0218* (2013.01); *B24B 31/023* (2013.01)

(58) Field of Classification Search
CPC ..... B24B 31/02; B24B 31/023; B24B 31/108; B24B 31/0218
USPC ..... 451/326, 327
See application file for complete search history.

(56) References Cited

U.S. PATENT DOCUMENTS 2,387,137 A * 10/1945 Fruth ..... B24B 31/023 134/7
3,823,512 A * 7/1974 Kobayashi ..... B24B 31/0218 451/329
4,363,194 A 12/1982 Balz
4,620,394 A * 11/1986 Temme ..... B24B 31/16 451/113

(Continued)

FOREIGN PATENT DOCUMENTS

CN 202242078 U 5/2012
CN 203471536 U 3/2014

(Continued)

OTHER PUBLICATIONS

Walther, DE-19614272-A1 machine translation, Oct. 16, 1997 (Year: 1997).*

(Continued)

*Primary Examiner* — Brian D Keller
*Assistant Examiner* — Marcel T Dion
(74) *Attorney, Agent, or Firm* — Faegre Drinker Biddle & Reath LLP

(57) ABSTRACT

A barrel polishing apparatus has a barrel tank. The barrel tank includes a cylindrical fixed tank having a center axis and a rotary disk provided to cover a bottom portion of the fixed tank and rotatable about the center axis. The barrel polishing apparatus further includes a tilting mechanism. The tilting mechanism has a tilting shaft extending in a horizontal direction to tilt the barrel tank around the tilting shaft. The tilting shaft is disposed closer to the upper edge of the fixed tank than a centroidal line extending parallel to the tilting shaft and passing through the center of gravity of the barrel tank when viewed from a direction parallel to an extending direction of the tilting shaft.

8 Claims, 8 Drawing Sheets

(56) References Cited

U.S. PATENT DOCUMENTS

| | | | | | |
|---|---|---|---|---|---|
| 4,884,372 | A * | 12/1989 | McNeil | B24B 31/108 451/328 |
| 4,949,510 | A * | 8/1990 | Kobayashi | B24B 31/037 451/6 |
| 4,958,776 | A * | 9/1990 | Walther | B24B 31/108 241/171 |
| 5,189,842 | A * | 3/1993 | Kobayashi | B24B 31/108 451/328 |
| 2002/0028630 | A1* | 3/2002 | Kobayashi | B24B 31/12 451/53 |
| 2012/0064804 | A1* | 3/2012 | Hammond | B24B 31/16 451/327 |
| 2016/0016278 | A1* | 1/2016 | Maeda | B24B 31/033 451/329 |
| 2016/0151874 | A1* | 6/2016 | Jensen | B24B 31/0212 134/184 |
| 2017/0259393 | A1* | 9/2017 | Kobayashi | B08B 7/02 |

FOREIGN PATENT DOCUMENTS

| | | | | | |
|---|---|---|---|---|---|
| CN | 203712477 | U | | 7/2014 | |
| CN | 104671133 | A | | 6/2015 | |
| CN | 206071061 | U | | 4/2017 | |
| CN | 109538273 | A | | 3/2019 | |
| DE | 19614272 | A1 | * | 10/1997 | B24B 31/003 |
| EP | 3222387 | A1 | * | 9/2017 | B24B 31/003 |
| JP | S55-107955 | U | | 7/1980 | |
| JP | S57-189766 | A | | 11/1982 | |
| JP | S58-082671 | A | | 5/1983 | |
| JP | S62-201651 | U | | 12/1987 | |
| JP | H05-038670 | A | | 2/1993 | |
| JP | H10-277917 | A | | 10/1998 | |
| JP | 2009214266 | A | * | 9/2009 | |
| WO | WO-2010003288 | A1 | * | 1/2010 | B24B 31/023 |

OTHER PUBLICATIONS

Owaki, JP-2009214266-A machine translation, Sep. 24, 2009 (Year: 2009).*

Second Chinese Office Action issued Jun. 14, 2024 in Application No. 202110196326.6.

* cited by examiner

*Fig.7*

| | COMPARATIVE EXAMPLE | | | |
|---|---|---|---|---|
| | NUMBER OF DENTS | SIZE OF DENT [μm] | | |
| | | MAXIMUM | MINIMUM | AVERAGE |
| 1 | 58 | 176.0 | 16.8 | 81.3 |
| 2 | 21 | 91.5 | 14.7 | 37.6 |
| 3 | 52 | 116.8 | 13.2 | 27.4 |
| 4 | 53 | 202.3 | 14.0 | 48.8 |
| 5 | 62 | 144.2 | 14.3 | 49.7 |
| 6 | 16 | 521.9 | 15.4 | 82.5 |
| 7 | 56 | 154.6 | 15.0 | 36.5 |
| 8 | 57 | 160.3 | 13.6 | 43.8 |
| 9 | 66 | 131.8 | 16.3 | 46.6 |
| 10 | 52 | 282.0 | 16.2 | 45.6 |
| AVERAGE | 49.3 | 198.1 | 15.0 | 50.0 |

*Fig.8*

| | EXAMPLE | | | |
|---|---|---|---|---|
| | NUMBER OF DENTS | SIZE OF DENT [μm] | | |
| | | MAXIMUM | MINIMUM | AVERAGE |
| 1 | 16 | 78.5 | 13.8 | 40.1 |
| 2 | 15 | 89.2 | 16.3 | 37.2 |
| 3 | 19 | 154.7 | 15.4 | 47.8 |
| 4 | 29 | 103.0 | 13.5 | 35.4 |
| 5 | 15 | 85.8 | 17.9 | 43.9 |
| 6 | 16 | 52.8 | 17.0 | 27.4 |
| 7 | 40 | 100.5 | 13.7 | 29.8 |
| 8 | 10 | 92.8 | 15.3 | 52.4 |
| 9 | 17 | 121.8 | 17.0 | 42.5 |
| 10 | 17 | 59.5 | 18.2 | 32.0 |
| AVERAGE | 19.8 | 93.9 | 15.8 | 38.9 |

BARREL POLISHING APPARATUS

CROSS-REFERENCE TO RELATED APPLICATION

This application is based on Japanese Patent Application No. 2020-033850 filed with Japan Patent Office on Feb. 28, 2020 and Japanese Patent Application No. 2020-174906 filed with Japan Patent Office on Oct. 16, 2020, the entire contents of which are hereby incorporated by reference.

TECHNICAL FIELD

The present disclosure relates to a barrel polishing apparatus.

BACKGROUND

A flow-type barrel polishing apparatus that polishes a workpiece by causing the workpiece to flow together with polishing media in a polishing space is known. For example, Japanese Unexamined Patent Publication No. S57-189766 discloses a barrel processing apparatus including a barrel tank including a cylindrical rigid body (fixed tank) and a disk-shaped rotary bottom portion (rotary disk), a protruding wall provided on an inner surface of the barrel tank, and a support mechanism to support the barrel tank such that the barrel tank is tiltable in a vertical plane and the fixed tank is rotatable about a central axis. This apparatus rotates the cylindrical rigid body about the central axis of the barrel tank in a state in which the central axis of the barrel tank is horizontally inclined to guide the workpiece and the polishing media along the protruding wall and discharge them from the upper edge of the barrel tank.

SUMMARY

In the apparatus described in Japanese Unexamined Patent Publication No. S57-189766, the barrel tank is tilted about a joint disposed at the bottom portion of the barrel tank. In this configuration, since the rotation radius of the upper edge of the barrel tank is increased, the distance between the upper edge of the barrel tank and the discharge position in the height direction is largely changed according to the tilting angle. Therefore, depending on the tilting angle of the barrel tank, the fall distance between the upper edge of the barrel tank and the discharge position becomes large, and the workpiece may be damaged by the impact at the time of falling.

Another cause of damage to the workpiece is mixing of a foreign matter during barrel polishing. In the apparatus described in Japanese Unexamined Patent Publication No. S57-189766, the position of the barrel tank is inevitably disposed at a high position because of the structure for tilting the barrel tank. Therefore, when a workpiece, polishing media, and the like are charged into the barrel tank, they are charged from a position higher than the operator's eye level. At this time, it is difficult to charge the workpiece, the polishing media, and the like while checking the state of the workpiece, the polishing media, and the like. Therefore, even if foreign matter is mixed, it is difficult to remove the foreign matter.

The apparatus described in Japanese Unexamined Patent Publication No. S57-189766 has not only the problem of causing damage to the workpiece as described above but also the problem of workability. When workpiece, polishing media, and the like are charged into the barrel tank, they are charged from a position higher than the operator's eye level, which is a heavy labor for the operator.

Further, when the workpiece is discharged, since the workpiece cannot be discharged only by tilting the barrel tank depending on the shape of the workpiece, it is necessary to visually check whether the workpiece is discharged or not. However, in the apparatus described in Japanese Unexamined Patent Publication No. S57-189766, since the barrel tank is inevitably disposed at a high position, the workability of checking the discharge state of the workpiece is poor.

Therefore, a barrel polishing apparatus capable of suppressing damage to the workpiece and having good workability is required.

The barrel polishing apparatus of one aspect is a barrel polishing apparatus having a barrel tank. The barrel tank includes a cylindrical fixed tank having a center axis and a rotary disk provided to cover a bottom portion of the fixed tank and rotatable about the center axis. The barrel polishing apparatus includes a tilting mechanism. The tilting mechanism has a tilting shaft extending in a horizontal direction to tilt the barrel tank around the tilting shaft. The tilting shaft is disposed closer to the upper edge of the fixed tank than a centroidal line extending parallel to the tilting shaft and passing through the center of gravity of the barrel tank when viewed from a direction parallel to an extending direction of the tilting shaft.

In the barrel polishing apparatus according to the aspect described above, since the tilting shaft is disposed close to the upper edge of the fixed tank when viewed from the direction parallel to the extending direction of the tilting shaft, the rotation radius of the upper edge of the barrel tank can be reduced. Therefore, even when the tilting angle of the barrel tank is changed, the change in the distance in the height direction between the upper edge of the barrel tank and the discharge position becomes small, and as a result, damage to the workpiece due to falling can be suppressed. In addition, since the barrel tank can be disposed at a low position due to the structure of the barrel polishing apparatus, it is possible to easily perform the charging operation or the checking operation of the workpiece.

In one embodiment, the tilting shaft may extend outside the barrel tank. Since the tilting shaft extends outside the barrel tank, the tilting shaft can be disposed close to the upper edge of the fixed tank.

In one embodiment, the barrel polishing apparatus may further comprise a chute attached to an upper edge of the fixed tank to guide the a workpiece discharged from the barrel tank in a discharge direction. By guiding the workpiece in the discharge direction by the chute, damage to the workpiece can be further suppressed.

In one embodiment, the barrel polishing apparatus may further comprise a sensor configured to detect that the barrel tank is horizontally supported.

In one embodiment, the tilting mechanism may further comprise a coupling member connecting the tilting shaft and the barrel tank and a cylinder having one end connected to the coupling member and another end. The barrel tank may be tilted around the tilting shaft by extension and contraction of the cylinder. The tilting mechanism may further include a rail extending in a direction perpendicular to the extending direction of the tilting shaft. The other end of the cylinder may be slidable along the rail.

In one embodiment, the barrel polishing apparatus may further comprise a tilt regulating member to regulate a tilting angle of the barrel tank within a predetermined range. The tilt regulating member can prevent the tilting angle of the barrel tank from becoming excessively large.

In one embodiment, the fixed tank includes a cylindrical rigid body and a first lining. The first lining covers an inner circumferential surface of the cylindrical rigid body. The rotary disk includes a disk-shaped rigid body rotatable about the center axis and a second lining. The second lining covers a inner surface of the disk-shaped rigid body. The rotary disk is rotatable in a state where a gap is formed between the first lining and the second lining, and the disk-shaped rigid body is formed with a convex portion protruding toward a polishing space defined by the cylindrical rigid body, and a periphery of the convex portion is covered with the second lining, a retreat space is formed between the inner circumferential surface of the cylindrical rigid body and the first lining, and the retreat space may be formed at a position overlapping the gap when viewed from a direction orthogonal to the center axis.

In the above embodiment, since the expansion of the first lining and the second lining toward the gap side can be suppressed, the width of the gap can be designed to be small. As a result, a thin workpiece can be polished. When the barrel tank is tilted, the workpiece having such shape may adhere to the inside wall of the barrel tank and may not be discharged freely. This phenomenon occurs particularly in wet polishing. In the barrel polishing apparatus according to the embodiment, since visibility of the inside of the barrel tank is improved when the workpiece is discharged, the workpiece may be easily discharged.

In one embodiment, the convex portion may overlap the gap when viewed from the direction orthogonal to the center axis, and a length of a portion of the convex portion overlapping the gap in a direction along the center axis may be one-third or more of a length of the gap in the direction along the center axis. In this embodiment, since the convex portion formed in the disk-shaped rigid body is disposed so as to overlap the gap, expansion of the second lining toward the gap can be more reliably suppressed.

According to one aspect and various embodiments of the present invention, it is possible to suppress damage to a workpiece and improve workability.

BRIEF DESCRIPTION OF THE DRAWINGS

FIG. 7 is a table showing an evaluation result of the workpiece discharged by a barrel polishing apparatus according to a comparative example.

FIG. 8 is a table showing an evaluation result of the workpiece discharged by a barrel polishing apparatus according to a example.

DETAILED DESCRIPTION

Figure 1:
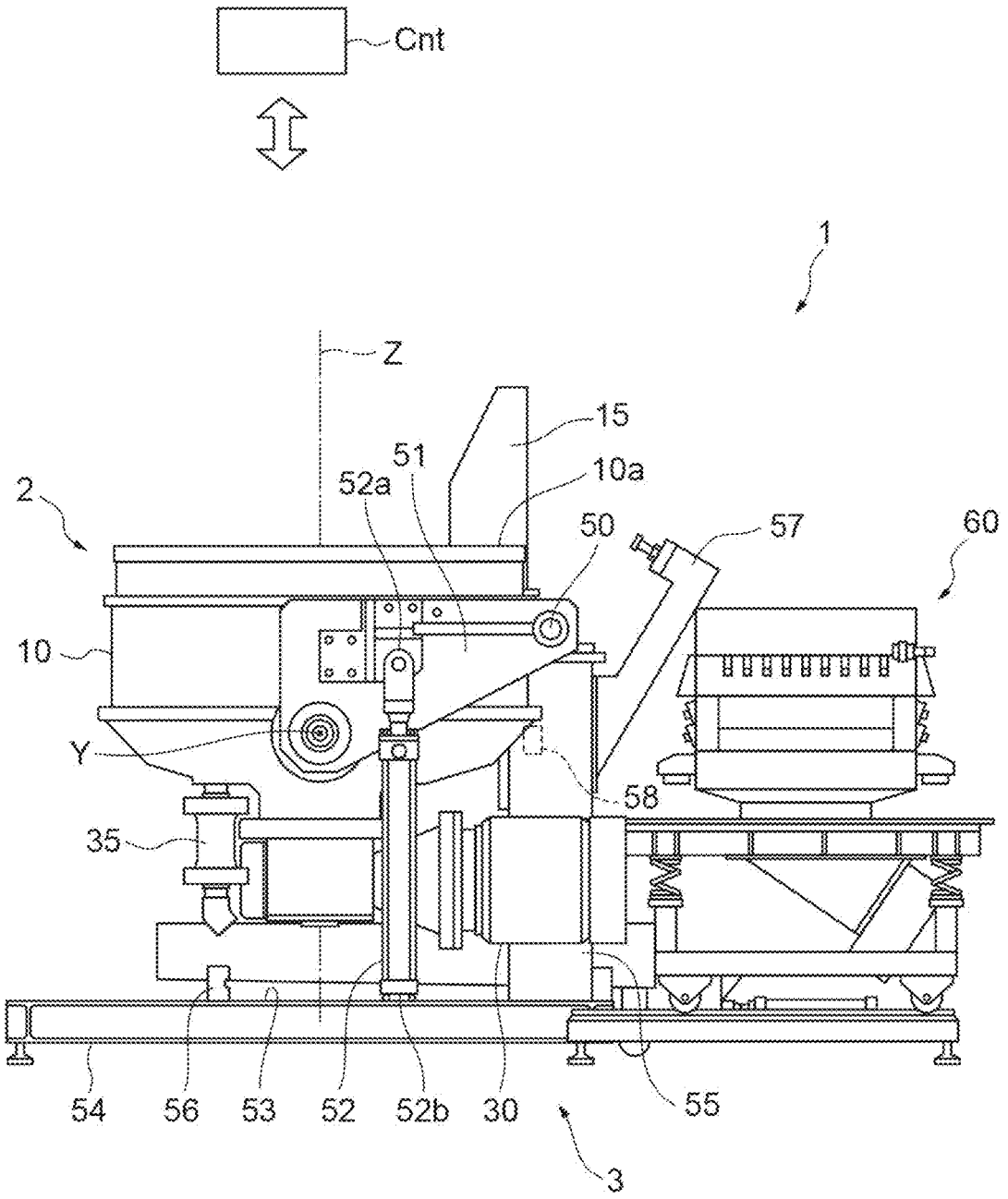
FIG. 1 is a side view schematically showing a barrel polishing apparatus according to an embodiment.

Hereinafter, embodiments of the present disclosure will be described with reference to the drawings. In the following description, the same or corresponding element is denoted by the same reference numeral, and redundant description will not be repeated. Dimension and ratio in the drawings do not necessarily match those in the description.

FIG. 1 is a side view schematically illustrating a barrel polishing apparatus according to an embodiment. The barrel polishing apparatus 1 shown in FIG. 1 is a flow-type barrel polishing apparatus for polishing a workpiece, and is disposed adjacent to a sorting device 60 for sorting the workpiece and polishing media. As shown in FIG. 1, the barrel polishing apparatus 1 includes a barrel tank 2 and a tilting mechanism 3.

Figure 2:
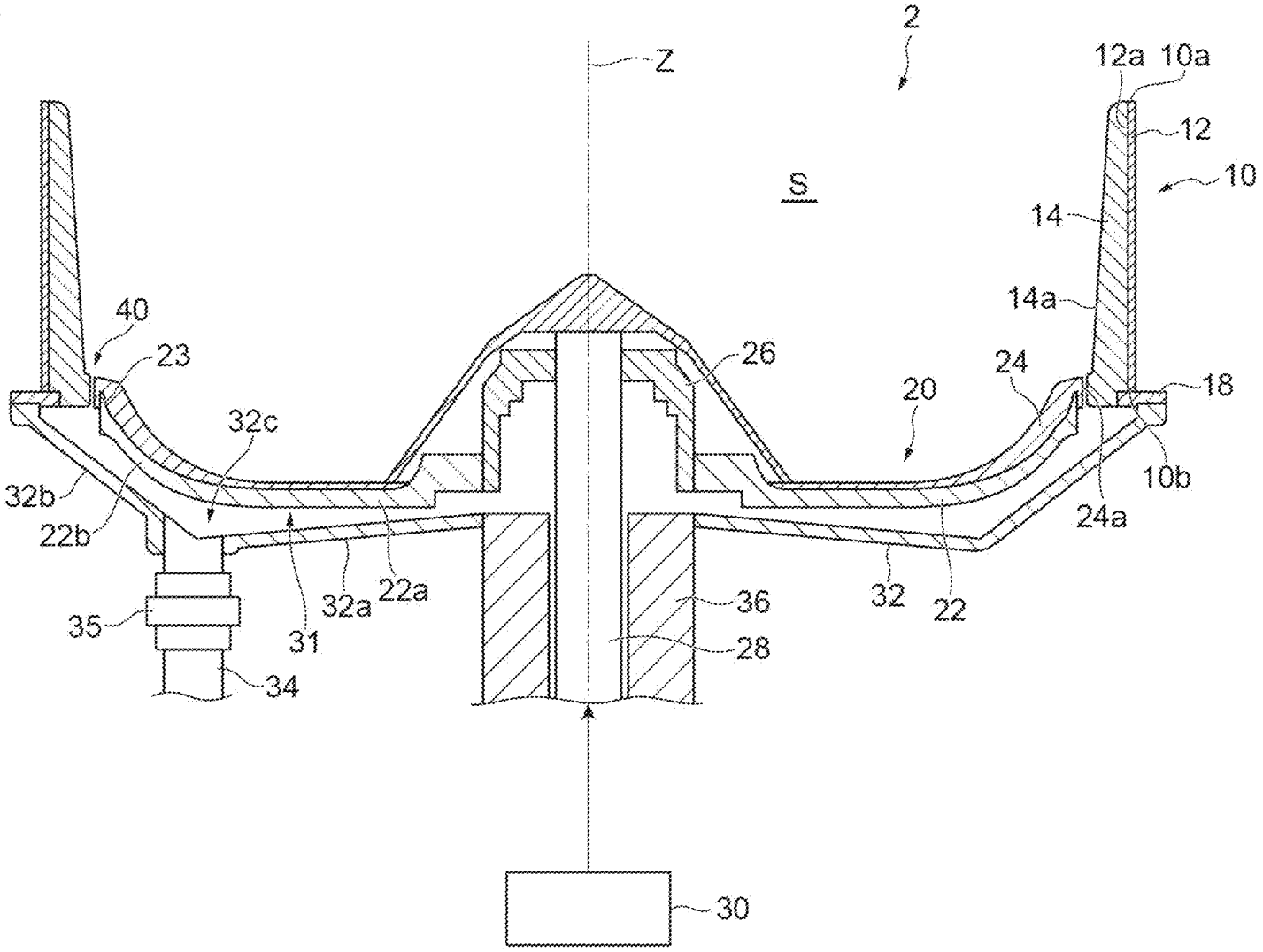
FIG. 2 is a cross-sectional view schematically showing a barrel tank.

FIG. 2 is a cross-sectional view schematically showing the barrel tank 2. As shown in FIG. 2, the barrel tank 2 includes a fixed tank 10 and a rotary disk 20. As shown in FIG. 2, the fixed tank 10 is formed in a cylindrical shape having the axis Z as a center axis, and a top portion and a bottom portion of the fixed tank 10 are opened. The fixed tank 10 has an upper edge 10*a* and a lower edge 10*b*. The fixed tank 10 includes a cylindrical rigid body 12 and a first lining 14. The cylindrical rigid body 12 is made of a rigid body such as metal and has a cylindrical shape with the axis Z as a center axis.

The inner circumferential surface 12*a* of the cylindrical rigid body 12 is covered by the first lining 14. The first lining 14 has a substantially cylindrical shape and is made of a wear-resistant material. The first lining 14 prevents the cylindrical rigid body 12 from being worn when the workpiece is polished. The material of the first lining 14 is exemplified by urethane resin, but is not limited to urethane resin as long as it is a polymer material having abrasion resistance.

A flange 18 is provided below the cylindrical rigid body 12. The flange 18 is formed in an annular shape and is fixed to the lower edge 10*b* of the fixed tank 10.

The flange 18 is supported by a support disk 32. The support disk 32 has a disk shape in which an opening is formed in a central portion thereof, and a radially inner end portion thereof is fixed to the base portion 36. The support disk 32 includes an inner region 32*a* that is inclined downward toward the radially outer side and an outer region 32*b* that is inclined upward toward the radially outer side. A retention portion 32*c* is formed between the inner region 32*a* and the outer region 32*b*. A discharge pipe 34 is connected to the support disk 32 so as to communicate with the retention portion 32*c*. The discharge pipe 34 is provided with a valve 35.

The rotary disk 20 is provided to cover a lower portion of the fixed tank 10. The rotary disk 20 defines a polishing space S for polishing the workpiece together with the fixed tank 10. The rotary disk 20 has a disk-shaped rigid body 22 and a second lining 24.

The disk-shaped rigid body 22 is provided above the support disk 32. The disk-shaped rigid body 22 is made of a rigid material such as metal and has a disk shape with an opening formed at the center thereof The disk-shaped rigid body 22 includes a central region 22*a* and an outer region 22*b* surrounding the central region 22*a*. In the outer region 22*b* of the disk-shaped rigid body 22, a convex portion 23 protruding toward the polishing space S along a direction parallel to the axis Z is formed. The convex portion 23 will be described in detail later.

The upper surface (surface on the polishing space S side) of the disk-shaped rigid body 22 is covered by the second lining 24. The second lining 24 has a disk shape in which an opening is formed at the center thereof, and is made of a wear-resistant material. The second lining 24 has a function of preventing the disk-shaped rigid body 22 from being worn when the workpiece is polished. The material of the second lining 24 is exemplified by urethane resin, but is not limited to urethane resin as long as it is a polymer material having abrasion resistance.

A gap 40 for allowing rotation of the rotary disk 20 is formed between the inner circumferential surface 14*a* of the first lining 14 and the end surface 24*a* of the second lining 24. In order to prevent the workpiece in the polishing space S from falling from the gap 40, a distance between the inner circumferential surface 14*a* of the first lining 14 and the end surface 24*a* of the second lining 24 (a width d of the gap 40 described below) is designed to be smaller than a width of the workpiece.

A radially inner end of the disk-shaped rigid body 22 is fixed to a coupling member 26, and the coupling member 26 is fixed to a rotating shaft 28. The rotating shaft 28 extends along the axis Z and is rotatable about the axis Z. A motor 30 is connected to the rotating shaft 28. The motor 30 generates a driving force for rotating the rotating shaft 28 about the axis Z, and transmits the driving force to the rotating shaft 28 via a transmission mechanism. When the driving force of the motor 30 is transmitted to the rotating shaft 28, the disk-shaped rigid body 22 rotates about the axis Z while the gap 40 is formed between the first lining 14 and the second lining 24.

When the disk-shaped rigid body 22 is rotated about the axis Z, the workpiece and the polishing media are spirally moved and flowed in the polishing space S by centrifugal force. By this flow, the workpiece and the polishing media collide with each other, and the workpiece is polished. When wet barrel polishing is performed, the workpiece and the polishing media, as well as water and compounds, are charged into the polishing space S and flowed therein.

A drain passage 31 is formed between the disk-shaped rigid body 22 and the support disk 32. The drain passage 31 is a passage used for discharging polishing debris of the workpiece generated by the barrel polishing, fragments of the polishing media (hereinafter, the polishing debris of the workpiece and the fragments of the polishing media are collectively referred to as "chips"), or a polishing liquid containing chips. The drain passage 31 communicates with the gap 40 and a retreat space 42 described later. The chips and the polishing liquid generated by the barrel polishing in the polishing space S pass through the gap 40 formed between the first lining 14 and the second lining 24 and are collected in the drain passage 31. The chips and the polishing liquid collected in the drain passage 31 are collected in the retention portion 32*c* and discharged from the discharge pipe 34 to the outside of the barrel polishing apparatus 1.

Next, the fixed tank 10 will be described in detail with reference to FIG. 3.

Figure 3:
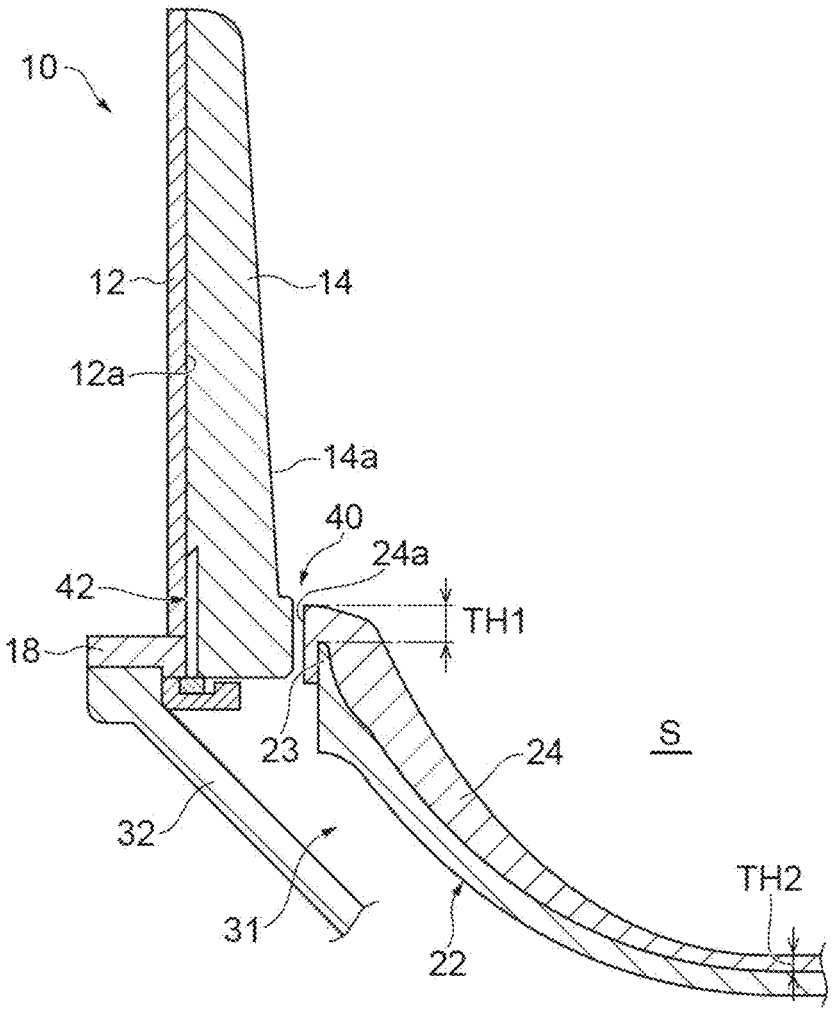
FIG. 3 is an enlarged cross-sectional view showing a part of the barrel tank.

As shown in FIG. 3, a retreat space 42 is formed between the inner circumferential surface 12*a* of the cylindrical rigid body 12 of the fixed tank 10 and the first lining 14. More specifically, the retreat space 42 is formed between the cylindrical rigid body 12 and the first lining 14. The retreat space 42 is formed at a position overlapping the gap 40 when viewed from a direction orthogonal to the axis Z (the left-right direction in FIG. 3).

When the workpiece charged into the polishing space S is subjected to barrel polishing, the temperature in the polishing space S rises due to frictional heat between the workpiece and the polishing media as the polishing time elapses. When the temperature of the first lining 14 rises as the temperature of the polishing space S rises, the first lining 14 thermally expands to increase its volume. At this time, since the first lining 14 has a cylindrical shape, the first lining 14 expands in the radial direction and enters the retreat space 42. On the other hand, the expansion of the first lining 14 toward the radially inner side is suppressed by an amount corresponding to the expansion of the first lining 14 toward the radially outer side. As a result, narrowing of the width d of the gap 40 (see FIG. 4) is suppressed.

Figure 4:
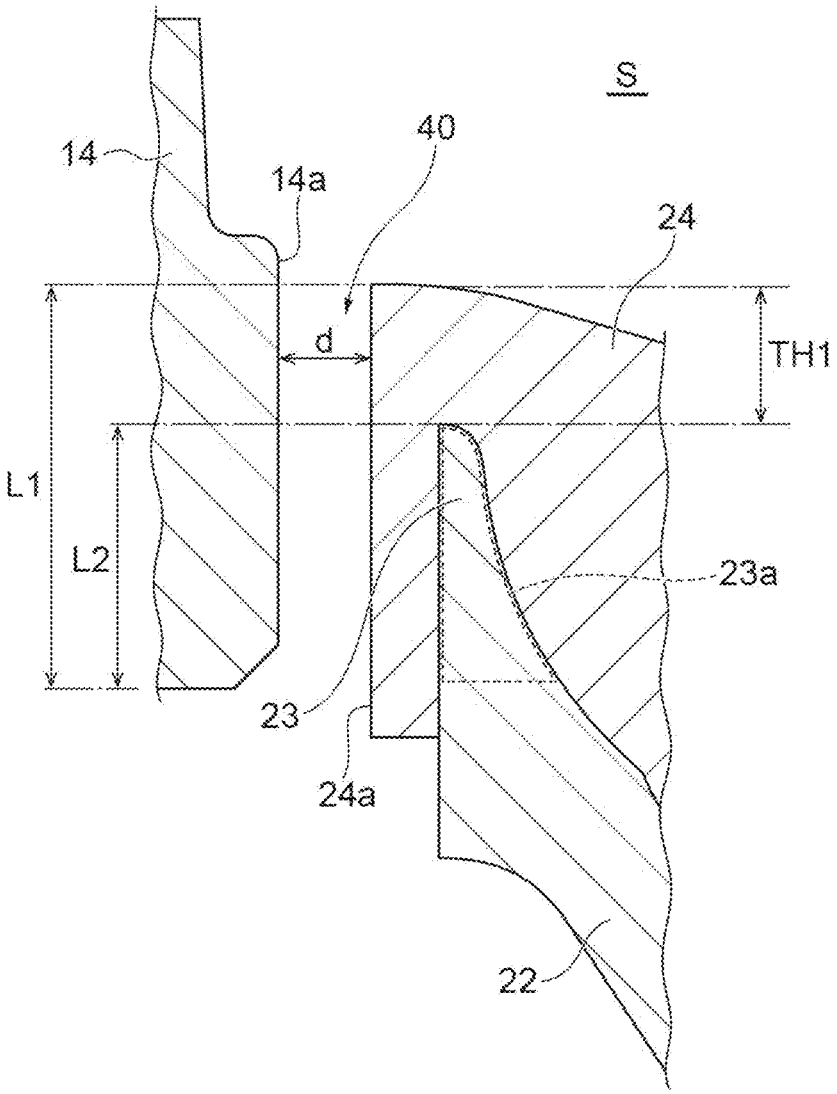
FIG. 4 is an enlarged cross-sectional view showing the periphery of the gap.

Next, the rotary disk 20 and the gap 40 will be described in detail with reference to FIGS. 3 and 4. As described above, the gap 40 is formed between the inner circumferential surface 14*a* of the first lining 14 and the end surface 24*a* on the outer circumferential side of the second lining 24. In the cross-sectional views shown in FIGS. 3 and 4, the inner circumferential surface 14*a* and the end surface 24*a* are arranged to face each other with a gap 40 interposed therebetween, and the gap 40 extends in a direction parallel to the axis Z between the inner circumferential surface 14*a* and the end surface 24*a*. As shown in FIG. 4, the gap 40 has a length L1 in the direction along the axis Z and a width d in the direction orthogonal to the axis Z.

A convex portion 23 is formed in the outer region 22*b* of the disk-shaped rigid body 22, more specifically, at a radially outer end of the disk-shaped rigid body 22. The convex portion 23 protrudes from the disk-shaped rigid body 22 in a direction parallel to the extending direction of the gap 40, that is, in the direction along the axis Z. The periphery of the convex portion 23 is covered with a second lining 24 so that the convex portion 23 is not exposed to the gap 40. Since the periphery of the convex portion 23 is covered with the second lining 24, the convex portion 23 is prevented from being worn by the chips or the polishing liquid passing through the gap 40.

The convex portion 23 is disposed so as to at least partially overlap the gap 40 when viewed from the direction orthogonal to the axis Z (the left-right direction in FIGS. 3 and 4). Here, when viewed from the direction orthogonal to the axis Z, the overlapping portion 23*a* of the convex portion 23 overlapping the gap 40 has a length L2 in the direction along the axis Z. The length L2 of the overlapping portion 23*a* is set to one-third or more of the length L1 of the gap 40. The length L2 of the overlapping portion 23*a* may be set to more than half of the length L1 of the gap 40.

The convex portion 23 has a function of restricting expansion of the second lining 24 toward the gap 40 (toward the outer periphery). That is, when the workpiece is polished in the polishing space S and the temperature in the polishing space S increases, the second lining 24 thermally expands and the second lining 24 increases in volume. Here, when the convex portion 23 extending in the direction along the axis Z is provided, the expansion of the second lining 24 toward the gap 40 side (outer circumferential side) is restricted, and the expansion of the second lining 24 proceeds toward the polishing space S side (the direction along the axis Z). Therefore, narrowing of the width d of the gap 40 due to expansion of the second lining 24 is suppressed. In particular, since the length L2 of the overlapping portion 23*a* of the convex portion 23 is set to one-third or more of the length L1 of the gap 40, it is possible to more reliably suppress the width d of the gap 40 from being narrowed.

As shown in FIG. 3, the second lining 24 formed on the convex portion 23 has a thickness TH 1 larger than the thickness TH 2 of the second lining 24 formed on the central region 22*a*. In the flow-type barrel polishing, since centrifugal force is generated by the rotation of the disk-shaped rigid body 22 and the workpiece and the polishing media spirally flow in the region adjacent to the fixed tank 10 in the polishing space S, the outer portion of the second lining 24 (a portion of the second lining 24 formed on the outer region 22*b*) is worn faster than the inner portion of the second lining 24 (a portion of the second lining 24 formed on the central region 22*a*). At this time, by making the thickness TH 1 of the second lining 24 on the convex portion 23 larger than the thickness TH 2 of the second lining 24 on the central region 22*a*, the second lining 24 is prevented from being worn and the convex portion 23 is prevented from being exposed to the polishing space S. Therefore, the life of the barrel polishing apparatus 1 can be improved.

Figure 5:
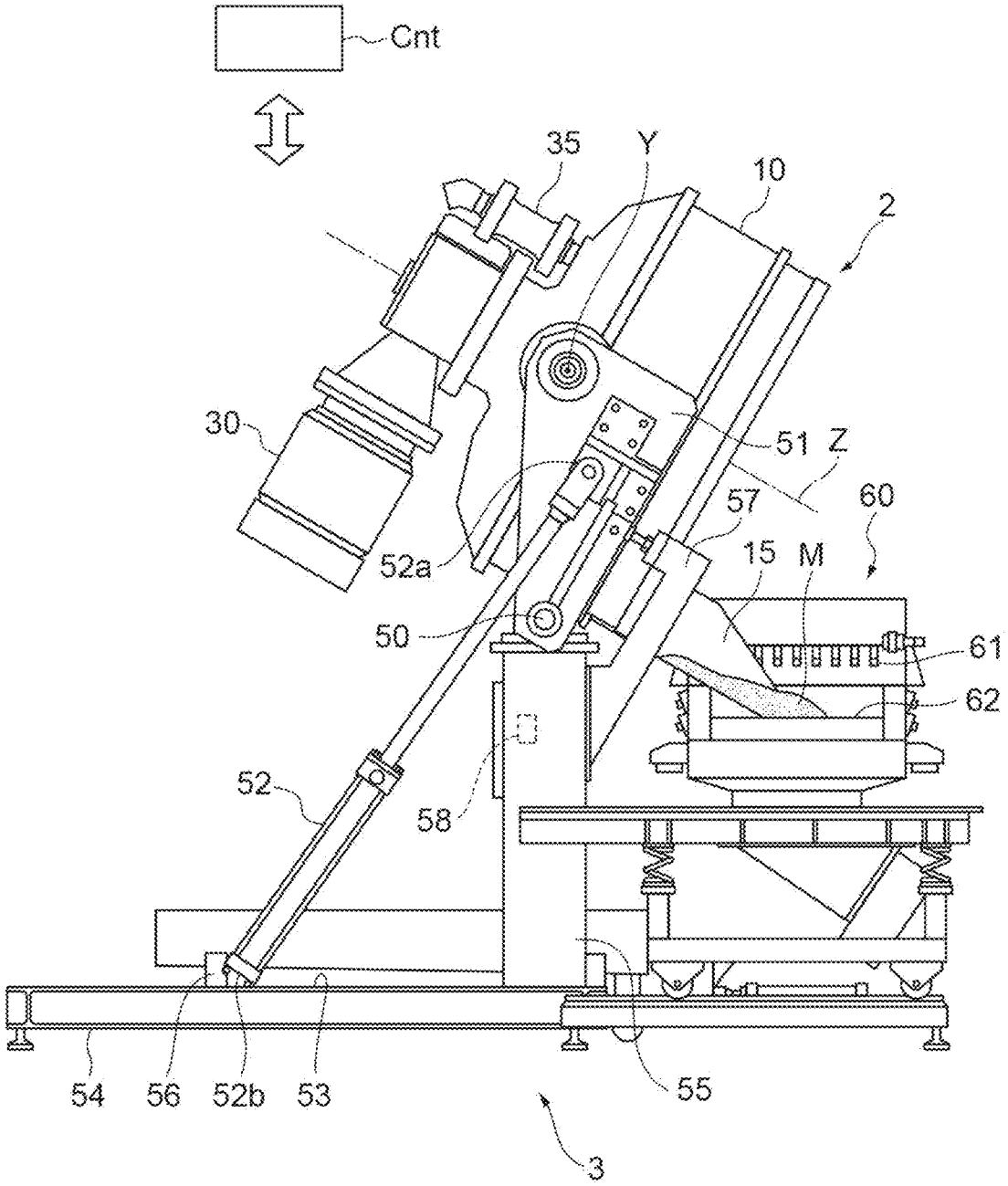
FIG. 5 is a side view showing the barrel polishing apparatus with the tilted barrel tank.

As shown in FIG. 1, a chute 15 for guiding the workpiece discharged from the barrel tank 2 to the sorting device 60 (discharge direction) may be attached to the upper edge 10*a* of the fixed tank 10 (see FIGS. 1 and 5). For example, the chute 15 is attached to the upper edge 10*a* at a position overlapping a plane including the axis Z and perpendicular to a tilting shaft 50 described later, and extends from the upper edge 10*a* in the direction along the axis Z.

As shown in FIG. 1, the tilting mechanism 3 tilts the barrel tank 2 in a vertical plane including the axis Z. The tilting mechanism 3 has a tilting shaft 50 serving as a fulcrum of tilting. As shown in FIG. 1, the tilting shaft 50 extends horizontally outside the barrel tank 2 and is supported on the frame 55 so as to be rotatable about the axis. Here, when an imaginary line extending in parallel to the tilting shaft 50 and passing through the center of gravity of the barrel tank 2 is defined as a centroidal line Y, the tilting shaft 50 is disposed closer to the upper edge 10*a* of the fixed tank 10 than the centroidal line Y when viewed from the direction parallel to the tilting shaft 50. For example, the tilting shaft 50 is disposed closer to the upper edge 10*a* than the axis Z in the radial direction of the barrel tank 2, and is disposed closer to the upper edge 10*a* than an intermediate position between the lower edge 10*b* and the upper edge 10*a* in the direction along the axis Z.

The tilting mechanism 3 further comprises a coupling member 51, a cylinder 52 and a rail 53. The coupling member 51 is formed in a plate shape, for example, and connects the tilting shaft 50 and the barrel tank 2. In the embodiment shown in FIG. 1, the coupling member 51 is fixed to the barrel tank 2 at a position overlapping the centroidal line Y.

The cylinder 52 applies a driving force for rotating the barrel tank 2 about the tilting shaft 50 to the barrel tank 2. The cylinder 52 is, for example, a hydraulic cylinder, and is configured to be extendable in the length direction. The cylinder 52 has one end 52*a* and the other end 52*b*, and the one end 52*a* is rotatably connected to the coupling member 51 at a position between the tilting shaft 50 and the centric line Y, for example.

The rail 53 is supported on a base 54 and extends along a direction perpendicular to the tilting shaft 50 in a horizontal plane. The other end 52*b* of the cylinder 52 is slidably supported on the rail 53. A slide stopper 56 for restricting the movement of the other end 52*b* is provided on the rail 53.

The operation of the tilting mechanism 3 will be described with reference to FIGS. 1 and 5. As shown in FIG. 1, before or during barrel polishing, the cylinder 52 of the tilting mechanism 3 horizontally supports the barrel tank 2 in a shortened state.

On the other hand, when the barrel tank 2 is tilted to discharge the workpiece, after completion of barrel polishing, the cylinder 52 is extended. When the cylinder 52 is extended, the other end 52*b* of the cylinder 52 slides along the rail 53 in a direction perpendicular to the tilting shaft 50, and then contacts with the slide stopper 56. When the cylinder 52 is further extended with the other end 52*b* in contact with the slide stopper 56, the barrel tank 2 is tilted about the tilting shaft 50 by the pressing force from the cylinder 52, as shown in FIG. 5. When the tilting angle of the barrel tank 2 reaches a certain degree, the mass M including the workpiece and the polishing media in the barrel tank 2 is discharged to the sorting device 60 via, for example, a chute 15. At this time, by bringing the height position of the sorting device 60 close to the height position of the tilting shaft 50, the falling distance of the mass M can be reduced, so that damage to the workpiece can be suppressed.

When the mass M is discharged from the barrel tank 2, the discharge of the mass M may be promoted by injecting a cleaning liquid from a cleaning nozzle into the inverted barrel tank 2.

The sorting device 60 sorts the workpiece and the polishing media by, for example, vibrating the mass M discharged from the barrel tank 2 on the screen 62 while supplying cleaning liquid from the cleaning nozzle 61.

In one embodiment, the tilting mechanism 3 may further include an inversion stopper 57 and a sensor 58. The inversion stopper 57 functions as a tilt regulating member that regulates the tilting angle of the barrel tank 2 within a predetermined range. As shown in FIG. 5, the inversion stopper 57 is fixed to, for example, the frame 55, and abuts against the coupling member 51 when the tilting angle of the barrel tank 2 reaches a predetermined maximum tilting angle θ to restrict the tilt of the barrel tank 2 exceeding the maximum tilting angle θ.

The sensor 58 detects that the barrel tank 2 is horizontally supported. The sensor 58 is, for example, a contact-type sensor, and is attached to the frame 55 so as to contact the barrel tank 2 when the barrel tank 2 is in the horizontal position. The sensor 58 may be attached to the barrel tank 2 and detect the horizontal state of the barrel tank 2 by detecting contact with the frame 55.

The barrel polishing apparatus 1 may further include a control device Cnt. The control device Cnt is a computer including a processor, a storage unit, an input device, a display device, and the like, and controls each unit of the barrel polishing apparatus 1. In the control device Cnt, an operator can perform an input operation of a command or the like for managing the barrel polishing apparatus 1 by using the input device, and the operation state of the barrel polishing apparatus 1 can be visualized and displayed by the display device. The storage unit of the control device Cnt stores a control program for controlling various processes performed by the barrel polishing apparatus 1 by the processor, and a program for causing each component of the barrel polishing apparatus 1 to perform a process according to a process condition.

Figure 6:
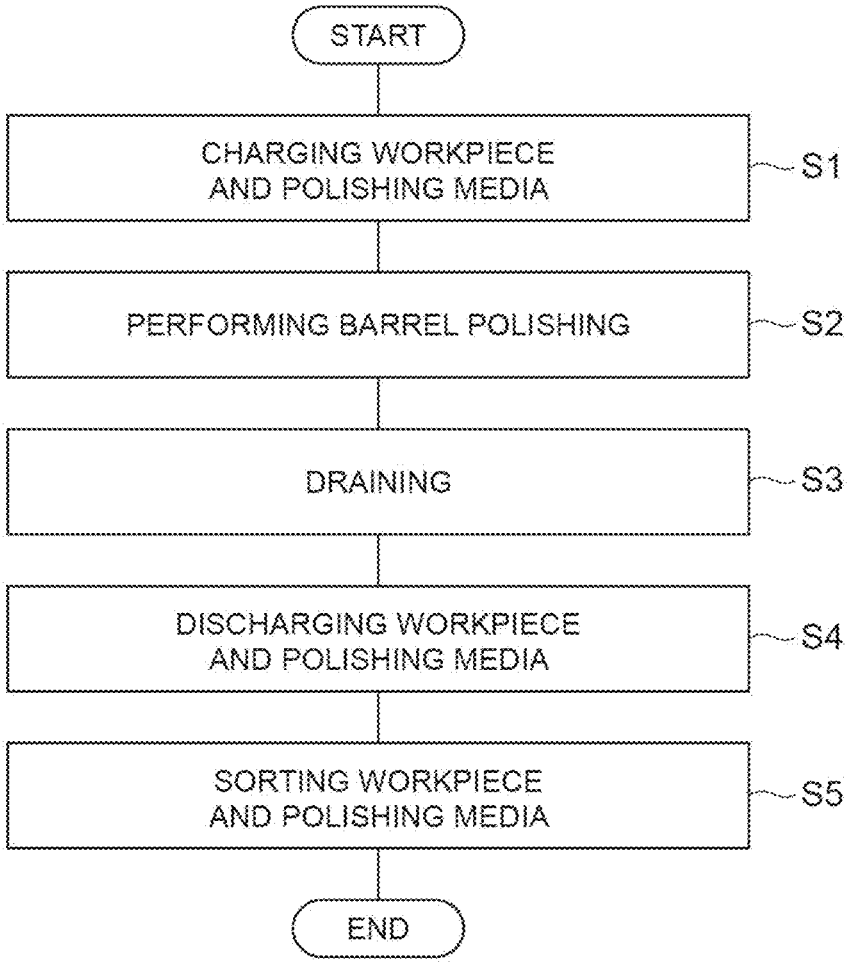
FIG. 6 is a flowchart showing a barrel polishing method according to an embodiment.

Next, an example of a barrel polishing method using the barrel polishing apparatus 1 will be described. FIG. 6 is a flowchart illustrating a barrel polishing method according to an embodiment. At least a part of the process shown in FIG. 6 is executed by the control device Cnt controlling each part of the barrel polishing apparatus 1.

In this barrel polishing process, first, the workpiece and the polishing media are charged into the barrel tank 2 (step S1). If necessary, water and a compound may be charged to the barrel tank 2. Hereinafter, a wet barrel polishing process in which water and compounds are charged into the barrel tank 2 with the workpiece and the polishing media will be described.

Next, the control device Cnt rotates the disk-shaped rigid body 22 to cause the workpiece and the polishing media to flow in the barrel tank 2, thereby performing barrel polishing (step S2). When the workpiece is barrel-polished for a certain period of time, the control device Cnt opens the valve 35 provided in the discharge pipe 34 to drain the treatment liquid in the barrel tank 2 (step S3).

Next, the control device Cnt tilts the barrel tank 2 to discharge the workpiece and the polishing media from the barrel tank 2 (step S4). More specifically, the control device Cnt extends the cylinder 52 to tilt the barrel tank 2 about the tilting shaft 50. When the tilting angle of the barrel tank 2 reaches a certain degree, the workpiece and the polishing media discharged from the upper edge 10*a* of the barrel tank 10 are transferred to the sorting device 60 through the chute 15.

Next, the sorting device 60 sorts the workpiece and the polishing media transferred from the barrel polishing apparatus 1 (step S5). At this time, the workpiece is cleaned with the cleaning liquid sprayed from the cleaning nozzle 61.

In the above-described barrel polishing apparatus 1, since the tilting shaft 50 is disposed close to the upper edge 10*a* of the fixed tank 10 when viewed from the direction parallel to the tilting shaft 50, even when the tilting angle of the barrel tank 10 is changed, it is possible to reduce the change in the fall distance between the upper edge 12*a* of the barrel tank 2 and the sorting device 60 as the discharge destination. Therefore, damage to the workpiece due to falling can be suppressed. The sorting device 60 may be provided with a shock absorbing lining in order to reduce the shock when the workpiece falls. Further, the sorting device 60 may be provided with a falling distance reducing chute having an inclined surface for reducing the distance in the height direction between the upper edge 12*a* of the barrel tank 10 and the sorting device 60. Further, in the barrel polishing apparatus 1, since the barrel tank 2 can be disposed at a low position due to the structure thereof, visibility can be improved, and as a result, it is possible to easily perform a charging operation or a checking operation of the workpiece. In particular, since the upper portion of the fixed tank 10 of the barrel tank 2 is opened, it is possible to discharge the barrel tank while visually checking the inside of the barrel tank when the barrel tank is tilted.

Next, the operation and effect of the barrel polishing apparatus 1 will be described in more detail based on examples and comparative examples, but the present invention is not limited to the following examples.

In examples and comparative examples, the polishing media, the dummy workpiece, and the evaluation workpieces were charged into a barrel tank having a volume of 190 L, and polishing was performed at a rotation speed of 130 $min^{-1}$ for one minute. As the polishing media, 70 L of Power Media V7-A6×10 manufactured by SINTOKOGIO, Ltd., which is a ceramic polishing material, was charged. As the dummy workpiece, 1000 pieces of L-shaped angles made of SS440 were charged. The dimensions of the dummy workpiece were 25 mm×25 mm×3 mm. As the evaluation workpieces, 10 pieces of products made of S45C were charged. The dimensions of the evaluation workpieces were 22 mm in diameter and 15 mm in length.

In the comparative example, a conventional barrel polishing apparatus having a tilting shaft in the vicinity of the centroidal line Y was used to discharge the polishing media, the polished dummy workpieces, and the polished evaluation workpieces to the sorting device 60 and sort the polishing media, dummy workpieces, and evaluation workpieces. Then, dents generated in the evaluation workpiece were evaluated. In the example, the barrel polishing apparatus 1 tilting the barrel tank 2 about the tilting shaft 50 disposed close to the upper edge 10*a* of the fixed tank 10 was used to discharge the polishing media, the polished dummy workpiece and the polished evaluation workpieces to the sorting device 60 and sort the polishing media, the dummy workpieces and the evaluation workpieces. Then, dents generated in the evaluation workpiece were evaluated.

FIG. 7 shows the evaluation result of the dent of the evaluation workpieces discharged by the barrel polishing apparatus according to the comparative example. FIG. 8 shows the evaluation result of the dent of the evaluation workpieces discharged by the barrel polishing apparatus according to the example. As shown in FIGS. 7 and 8, it was confirmed that when the barrel polishing apparatus 1 according to the example was used, the average number of dents generated in the evaluation workpieces was reduced, and the average size of the dents could be reduced. From these results, it was confirmed that the barrel polishing apparatus 1 can suppress damage to the workpiece due to falling.

Although the barrel polishing apparatus according to various embodiments has been described above, the present invention is not limited to the above-described embodiments, and various modifications can be made without departing from the scope of the invention.

For example, in the above-described embodiment, the barrel tank 2 is tilted using the extendable cylinder 52, but means for tilting the barrel tank 2 is not limited to the cylinder 52 as long as the barrel tank 2 can be tilted at least around the tilting shaft 50 disposed close to the upper edge 10*a*. For example, the barrel tank 2 may be rotated around the tilting shaft 50 by a driving force of a motor.

The discharge destination of the workpiece is not limited to the sorting device 60, and the barrel polishing apparatus 1 can discharge the workpiece to an arbitrary discharge destination.

REFERENCE SIGNS LIST

1: barrel polishing apparatus, 2: barrel tank, 3: tilting mechanism, 10: fixed tank, 10*a*: upper edge, 12: cylindrical rigid body, 12*a*: inner circumferential surface, 14*a*: inner circumferential surface, 14: first lining, 24: second lining, 15: chute, 20: rotary disk, 22: disk-shaped rigid body, 23: convex portion, 40: gap, 42: retreat space, 50: tilting shaft, 51: coupling member, 52: cylinder, 52*a*: one end, 52*b*: another end, 53: rail, 58: sensor, S: polishing space, Y: centroidal line.

What is claimed is:

1. A barrel polishing apparatus having a barrel tank including a cylindrical fixed tank having a center axis and a rotary disk provided to cover a bottom portion of the fixed tank and rotatable about the center axis, comprising a tilting mechanism having a tilting shaft extending in a horizontal direction to tilt the barrel tank around the tilting shaft, wherein the tilting shaft is disposed closer to an upper edge of the fixed tank than a centroidal line extending parallel to the tilting shaft and passing through a center of gravity of the barrel tank when viewed from a direction parallel to an extending direction of the tilting shaft, wherein the tilting mechanism comprises:

a coupling member connecting the tilting shaft and the barrel tank;

a rail extending in a direction perpendicular to the extending direction of the tilting shaft;

a cylinder having one end connected to the coupling member and another end slidable along the rail; and a slide stopper provided on the rail to restrict movement of the other end of the cylinder, wherein the cylinder is configured to extend in a state in which the other end is in contact with the slide stopper to tilt the barrel tank around the tilting shaft.

2. The barrel polishing apparatus according to claim 1, wherein the tilting shaft extends outside the barrel tank.

3. The barrel polishing apparatus according to claim 1, further comprising a chute attached to the upper edge of the fixed tank to guide a workpiece discharged from the barrel tank in a discharge direction.

4. The barrel polishing apparatus according to claim 1, further comprising a sensor configured to detect that the barrel tank is horizontally supported.

5. The barrel polishing apparatus according to claim 1, further comprising a tilt regulating member to abut against the coupling member when a tilting angle of the barrel tank reaches a maximum tilting angle to regulate the tilting angle of the barrel tank within a predetermined range.

6. The barrel polishing apparatus according to claim 1, wherein the fixed tank includes a cylindrical rigid body and a first lining covering an inner circumferential surface of the cylindrical rigid body, the rotary disk includes a disk-shaped rigid body rotatable about the center axis and a second lining covering an inner surface of the disk-shaped rigid body, and is rotatable in a state where a gap is formed between the first lining and the second lining, the disk-shaped rigid body is formed with a convex portion protruding toward a polishing space defined by the cylindrical rigid body, and a periphery of the convex portion is covered with the second lining, a retreat space is formed between the inner circumferential surface of the cylindrical rigid body and the first lining, and the retreat space is formed at a position overlapping the gap when viewed from a direction orthogonal to the center axis.

7. The barrel polishing apparatus according to claim 6, wherein the convex portion overlaps the gap when viewed from the direction orthogonal to the center axis, and a length of a portion of the convex portion overlapping the gap in a direction along the center axis is one-third or more of a length of the gap in the direction along the center axis.

8. The barrel polishing apparatus according to claim 1, wherein the coupling member is fixed to the barrel tank at a position overlapping the centroidal line, and wherein the one end of the cylinder is rotatably connected to the coupling member at a position between the tilting shaft and the centroidal line.

* * * * *